US010101074B2

(12) United States Patent
Morgan et al.

(10) Patent No.: US 10,101,074 B2
(45) Date of Patent: Oct. 16, 2018

(54) ICE MAKER AIR FLOW RIBS

(71) Applicant: Electrolux Home Products, Inc., Charlotte, NC (US)

(72) Inventors: Justin Morgan, Anderson, SC (US); Jorge Carlos Montalvo Sanchez, Anderson, SC (US); Thomas McCollough, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 1 day.

(21) Appl. No.: 15/134,462

(22) Filed: Apr. 21, 2016

(65) Prior Publication Data

US 2017/0307281 A1 Oct. 26, 2017

(51) Int. Cl.

| | |
|---|---|
| ***F25D 17/06*** | (2006.01) |
| ***F25C 5/185*** | (2018.01) |
| ***F25C 5/06*** | (2006.01) |
| ***F25C 5/20*** | (2018.01) |
| *F25D 17/04* | (2006.01) |

(52) U.S. Cl.

CPC ..... *F25D 17/065* (2013.01); *F25C 5/06* (2013.01); *F25C 5/185* (2013.01); *F25C 5/22* (2018.01); *F25D 17/045* (2013.01); *F25D 17/062* (2013.01); *F25D 2317/063* (2013.01)

(58) Field of Classification Search

CPC ..... F25D 2317/063; F25D 17/062; F25D 17/045; F25C 5/005; F25C 5/007

USPC ..... 62/404, 407, 420, 425

See application file for complete search history.

(56) References Cited

U.S. PATENT DOCUMENTS

| | | | | |
|---|---|---|---|---|
| 5,766,069 | A * | 6/1998 | Baek | B60H 1/345 454/153 |
| 6,732,537 | B1 * | 5/2004 | Anell | F25C 1/04 62/353 |
| 8,220,286 | B2 * | 7/2012 | Cushman | F25D 17/065 62/187 |
| 8,281,613 | B2 | 10/2012 | An et al. | |
| 2007/0293134 | A1 * | 12/2007 | Shimada | B60H 1/3407 454/121 |
| 2009/0064703 | A1 * | 3/2009 | Kim | F25C 5/005 62/344 |
| 2010/0037631 | A1 * | 2/2010 | Choi | F25C 5/005 62/66 |
| 2010/0319373 | A1 | 12/2010 | Jeong et al. | |
| 2011/0100046 | A1 | 5/2011 | Choi et al. | |

(Continued)

*Primary Examiner* — Frantz Jules
*Assistant Examiner* — Lionel Nouketcha
(74) *Attorney, Agent, or Firm* — Pearne & Gordon LLP

(57) ABSTRACT

A refrigeration appliance includes a freezer compartment for storing food items. An ice maker is disposed within the freezer compartment and includes a removable ice bin having an internal cavity. A front cover closes a front open end of the ice bin. The front cover includes a front face oriented toward a front of the freezer compartment, a rear face, and a recess formed in the rear face. The rear face of the front cover is disposed adjacent to a horizontal edge portion of the ice maker when the removable ice bin is disposed within the ice maker wherein the recess defines a gap between the front cover and the horizontal edge portion that fluidly communicates with the internal cavity of the removable ice bin. A plurality of ribs is disposed within the gap for directing air exiting the internal cavity of the removable ice bin into a predetermined direction.

20 Claims, 7 Drawing Sheets

(56) References Cited

U.S. PATENT DOCUMENTS

| | | | | |
|---|---|---|---|---|
| 2012/0174613 | A1 | 7/2012 | Park et al. | |
| 2013/0167576 | A1* | 7/2013 | Kim | F25C 1/00 62/344 |
| 2015/0338155 | A1* | 11/2015 | Heinzle et al. | F25D 17/04 62/407 |

* cited by examiner

ICE MAKER AIR FLOW RIBS

FIELD OF THE INVENTION

This application relates generally to an ice maker for a refrigeration appliance, and more particularly, to a refrigeration appliance including an ice maker disposed within a freezer compartment of a refrigerator that is maintained at a temperature below a freezing temperature of water at atmospheric conditions.

BACKGROUND OF THE INVENTION

Conventional side-by-side refrigeration appliances, such as domestic refrigerators, require a large space in an upper portion of a freezer compartment for an ice maker. The large size of the ice maker reduces that amount of storage available to a user. In instances where the ice maker does not contact both sides of the freezer compartment, the ice maker only leaves enough space for one or two long, narrow packages, e.g., pizza boxes.

Accordingly, there is a need in the art for a refrigerator including an ice maker disposed within a freezer compartment of the refrigerator that creates an enlarged space laterally of the ice making unit for increased food storage while still providing for efficient cooling of the freezer compartment.

BRIEF SUMMARY OF THE INVENTION

In accordance with one aspect, there is provided a refrigeration appliance that includes a freezer compartment for storing food items in a sub-freezing environment having a target temperature below zero degrees Centigrade. An ice maker is disposed within the freezer compartment for freezing water into ice pieces. The ice maker includes a removable ice bin having an internal cavity for storing the ice pieces produced within the ice maker, and a front cover for closing a front open end of the removable ice bin. The front cover includes a front face oriented toward a front of the freezer compartment, a rear face, and a recess formed in the rear face. The rear face of the front cover is disposed adjacent to a horizontal edge portion of the ice maker when the removable ice bin is disposed within the ice maker wherein the recess in the front cover defines a gap between the front cover and the horizontal edge portion that fluidly communicates with the internal cavity of the removable ice bin. A plurality of ribs is disposed within the gap for directing air exiting the internal cavity of the removable ice bin into a predetermined direction toward a central portion of the freezer compartment.

In accordance with another aspect, there is provided a refrigeration appliance that includes a freezer compartment for storing food items in a sub-freezing environment having a target temperature below zero degrees Centigrade. An ice maker is disposed within the freezer compartment for freezing water into ice pieces. The ice maker includes a frame having a horizontal edge portion, a removable ice bin having an internal cavity for storing the ice pieces produced within the ice maker, and a front cover for closing a front open end of the removable ice bin. The front cover includes a front face oriented toward a front of the freezer compartment, a rear face, and a recess formed in the rear face. The rear face of the front cover is disposed adjacent to the horizontal edge portion of the frame when the removable ice bin is disposed within the frame wherein the recess in the front cover defines a gap between the frame and the removable ice bin that fluidly communicates with the internal cavity of the removable ice bin. A plurality of ribs is disposed within the gap for directing air exiting the internal cavity of the removable ice bin into a predetermined direction toward a central portion of the freezer compartment.

In accordance with yet another aspect, there is provided a refrigeration appliance that includes a freezer compartment for storing food items in a sub-freezing environment having a target temperature below zero degrees Centigrade. An ice maker is disposed within the freezer compartment for freezing water into ice pieces. The ice maker includes a removable ice bin that includes a housing having an internal cavity for storing the ice pieces produced within the ice maker and a horizontal edge portion. A front cover is provided for closing a front open end of the housing. The front cover includes a front face oriented toward a front of the freezer compartment, a rear face, and a recess formed in the rear face. The rear face of the front cover is disposed adjacent to the horizontal edge portion of the housing wherein the recess in the front cover defines a gap between the front cover and the housing that fluidly communicates with the internal cavity of the housing. A plurality of ribs is disposed within the gap for directing air exiting the internal cavity of the housing into a predetermined direction toward a central portion of the freezer compartment.

DESCRIPTION OF EXAMPLE EMBODIMENTS

Figure 1:
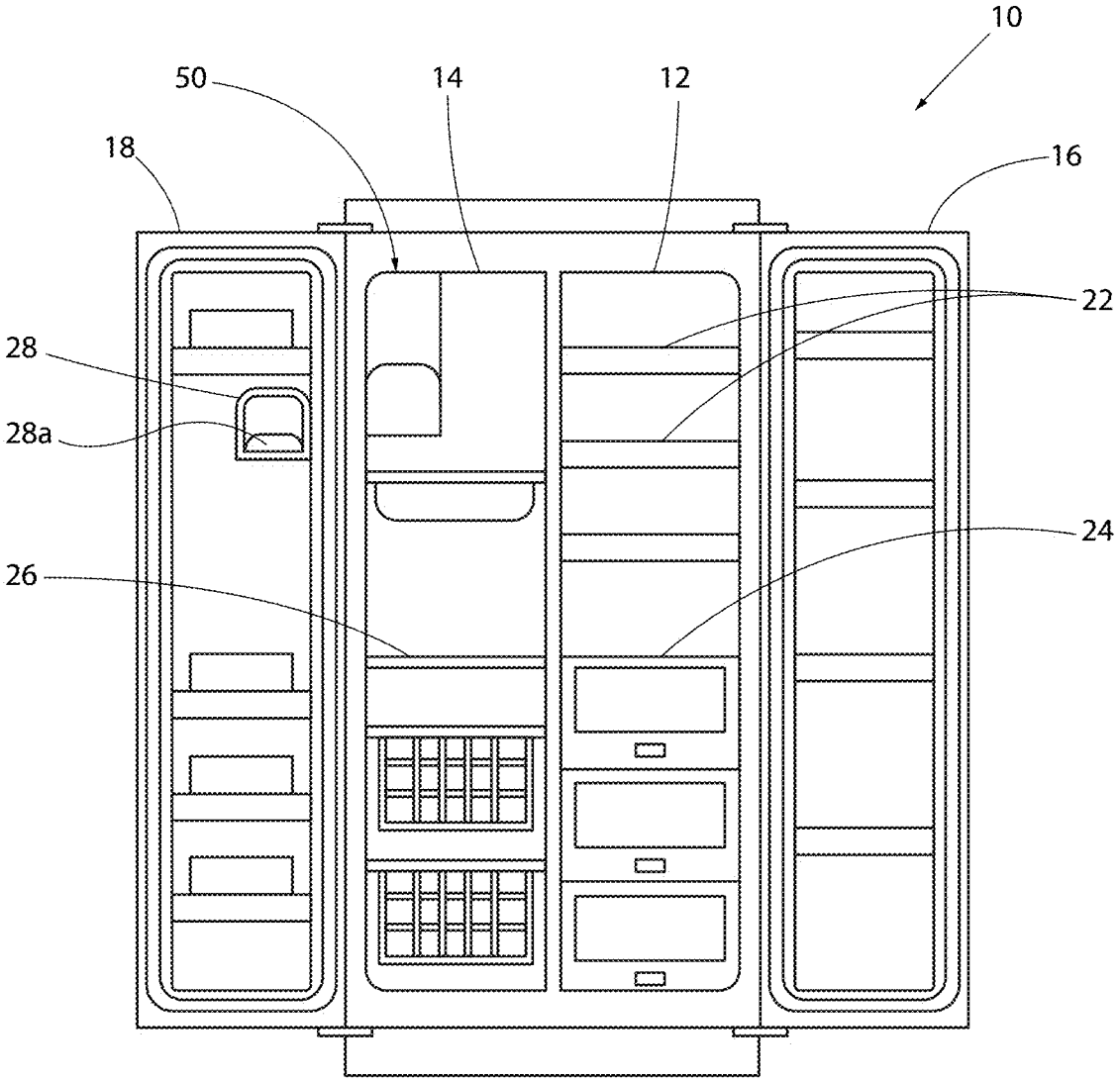
FIG. 1 is a front elevational view of a household side-by-side refrigerator showing doors of the refrigerator in an open position.

Referring now to the drawings, FIG. 1 shows a typical household refrigerator 10 comprising a fresh food compartment 12 and a freezer compartment 14. A door 16, shown in FIG. 1 as open, is mounted to the refrigerator body by hinges and serves to close the front of the fresh food compartment 12 as well as provide access to the interior of the fresh food compartment 12. A door 18 is mounted to the refrigerator body by hinges and serves to close the front of the freezer compartment 14 as well as provide access to the interior of the freezer compartment 14. The fresh food and freezer compartments 12, 14 may include a variety of shelves 22, closed drawers 24 and basket-like drawers 26 for storing articles of food and the like.

A dispenser (not shown) for dispensing at least ice pieces, and optionally water, is provided on door 18. The dispenser includes a lever, switch, proximity sensor or other device that a user can interact with to cause frozen ice pieces to be dispensed from an ice maker 50 disposed within the freezer compartment 14 through the door 18. Ice pieces from the ice maker 50 can be delivered to the dispenser via an ice chute 28, which extends at least partially through the door 18 between the dispenser and the ice bin 52.

The fresh food compartment 12 serves to minimize spoiling of articles of food stored therein by maintaining the temperature in the fresh food compartment 12 during operation at a cool temperature that is typically less than an ambient temperature of the refrigerator 10, but somewhat above 0° C., so as not to freeze the articles of food in the fresh food compartment 12. An evaporator is used to separately maintain the temperature within the fresh food compartment 12 independent of the freezer compartment 14. According to an embodiment, the temperature in the fresh food compartment 12 can be maintained at a cool temperature within a close tolerance of a range between 0° C. and 4.5° C., including any subranges and any individual temperatures falling with that range. For example, other embodiments can optionally maintain the cool temperature within the fresh food compartment 12 within a reasonably close tolerance of a temperature between 0.25° C. and 4° C.

The freezer compartment 14 is used to freeze and/or maintain articles of food stored in the freezer compartment 14 in a frozen condition. For this purpose, an evaporator (not shown) provides a cooling effect to the freezer compartment 14. The evaporator is supported within the freezer compartment 14, and an electric fan (not shown) is located adjacent to the evaporator. Operation of the electric fan draws the airflow upward over the fins and coils of the evaporator, and then in a forward direction, generally parallel to the ceiling portion of the freezer compartment 14 and toward a front of the freezer compartment 14, as described in detail below.

The evaporator also reduces a temperature of the air within the ice maker 50 (FIG. 2) for freezing water into the ice pieces and for maintaining a temperature in an ice bin 52 of the ice maker 50. In one example, the refrigeration circuit includes a variable-speed compressor for compressing gaseous refrigerant to a high-pressure refrigerant gas. The compressor can optionally be infinitely variable, or can be varied between a plurality of predetermined, discrete operational speeds depending on the demand for cooling. The high-pressure refrigerant gas from the compressor can be conveyed through a suitable conduit such as a copper tube to a condenser, which cools the high-pressure refrigerant gas and causes it to at least partially condense into a liquid refrigerant.

Figure 2:
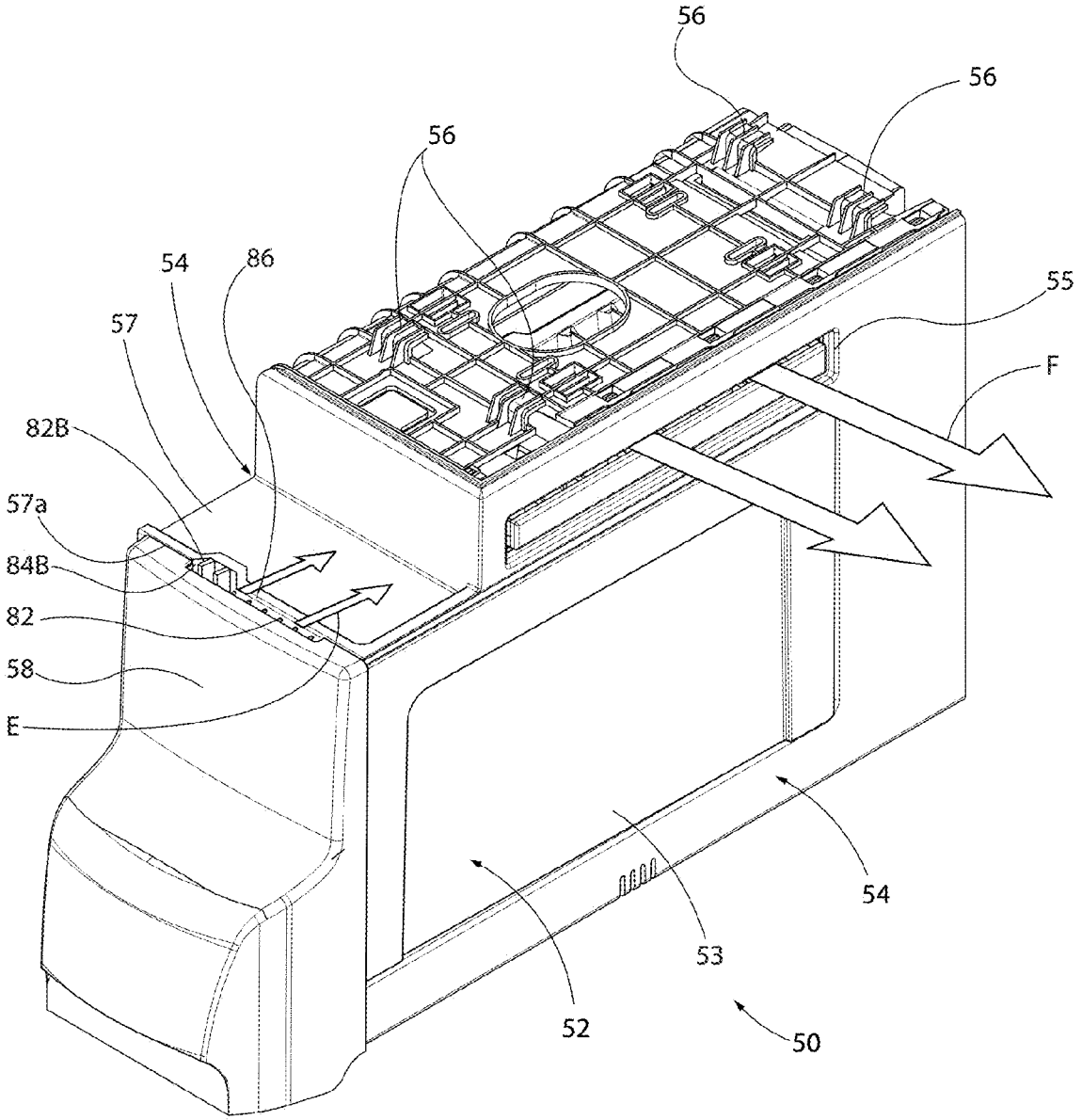
FIG. 2 is a perspective view of an ice maker.

An illustrative embodiment of the ice maker 50 is shown in FIG. 2. In general, the ice maker 50 includes a frame 54 and an ice bin 52 that stores ice pieces made by the ice maker 50. The ice maker 50 is secured within the freezer compartment 14 using any suitable fastener. The frame 54 is generally rectangular in shape for receiving the ice bin 52. A plurality of mounts 56 is disposed on a top of the frame 54 for securing the ice maker 50 within the freezer compartment 14 of the refrigerator 10. A rectangular side opening 55 is formed in an upper portion of a side wall of the frame 54 of the ice maker 50. The side opening 55 is positioned to be adjacent to or in registry with a space above an ice tray 62 disposed within the ice maker 50. The ice bin 52 is dimensioned to be selectively removable from the frame 54, as desired.

The ice bin 52 includes a housing 53 having an open, front end and an open top. A front cover 58 is secured to a front of the housing 53 to enclose the open, front end of the housing 53. When secured together to form the ice bin 52, the housing 53 and the front cover 58 define an internal cavity 52*a* (FIG. 4) of the ice bin 52 used to store the ice pieces. The front cover 58 may be secured to the housing 53 by mechanical fasteners that can be removed using a suitable tool, examples of which include screws, nuts and bolts, or any suitable friction fitting possibly including a system of tabs allowing removal of the front cover 58 from the housing 53 by hand and without tools. Alternatively, the front cover 58 is non-removably secured in place on the housing 53 using methods such as, but not limited to, adhesives, welding, non-removable fasteners, etc. In various other examples, a hidden latch to secure the ice bin 52 in frame 54 is desirable on the front cover 58 for cosmetic and ergonomic reasons. The frame 54 includes a horizontal plate portion 57 that is dimensioned to close a portion of the open top of the housing 53 of the ice bin 52 when the ice bin 52 is disposed in the frame 54. The horizontal plate portion 57 includes a front horizontal edge 57*a* that is dimensioned to engage the front cover 58 of the ice bin 52.

Figure 7:
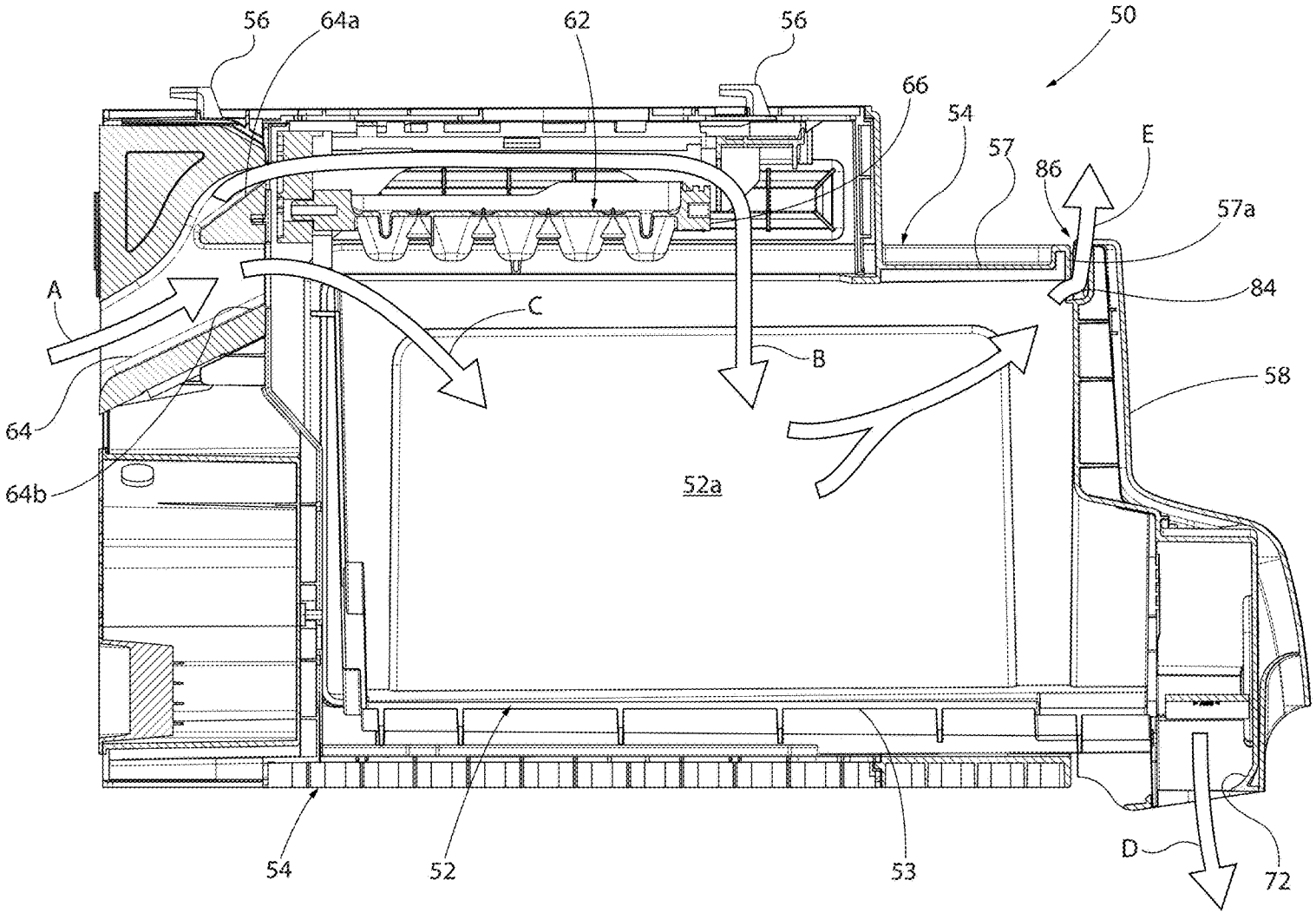
FIG. 7 is a section view take along line 7-7 of FIG. 5.

Referring now to FIG. 7, an ice tray 62 is positioned in an upper portion of the ice maker 50. In one example, the ice tray 62 is a twist-tray type, in which the ice tray 62 is rotated upside down and twisted along its longitudinal axis to thereby break the frozen ice pieces free from the ice reservoirs of the ice tray 62 where they fall into the internal cavity 52*a* of the ice bin 52 located below the ice tray 62. Still, a conventional metal water tray with a plurality of sweeper-arms and a harvest heater for partially melting the ice pieces, or even other types of ice maker assemblies like the finger-evaporator type, could also be utilized.

For simplicity, many of the internal components of the ice maker 50 are not shown in the present application. A main inlet channel 64 extends through a back of the frame 54 of the ice maker 50. The channel 64 defines an air inlet pathway "A" of the ice maker 50. The channel 64 divides into a first branch 64*a* that fluidly communicates with the space above the ice tray 62 and a second branch 64*b* that fluidly communicates with the underside of the ice tray 62 and the internal cavity 52*a* of the ice bin 52. A channel 66 is formed in the frame 54 at a front of the ice tray 62. The channel 66 fluidly connects the space above the ice tray 62 with the internal cavity 52*a* of the ice bin 52. The first branch 64*a*, the space above the ice tray 62 and the channel 66 define an upper air pathway "B" of the ice maker 50. The second branch 64*b*, the space below the ice tray 62, and in the internal cavity 52*a* define a lower air pathway "C" of the ice maker 50.

As shown in FIG. 7, the front cover 58 encloses a front open end of the housing 53 of the ice bin 52. The front cover 58 includes a lower channel 72 for allowing the ice pieces to exit the internal cavity 52*a* of the ice bin 52. The lower channel 72 is dimensioned and positioned to be in registry with an aperture 28*a* of the ice chute 28 in the door 18 when the door 18 is in the closed position. The lower channel 72 defines an ice piece exit pathway "D" for conveying ice pieces from the internal cavity 52*a* of the ice bin 52.

A rotatable auger (not shown) is positioned within the ice bin 52 and is configured to drive the ice pieces out of the ice bin 52 via a driving force applied in a first direction. In particular, the auger is rotated to push the ice pieces toward the front of the ice bin 52 (i.e., towards the front cover 58) wherein an ice crusher (not shown) is disposed. The ice crusher is provided for crushing the ice pieces conveyed thereto, when a user requests crushed ice.

As noted above, there is a need for an ice maker that creates an enlarged space laterally of the ice maker for increased food storage while still providing for efficient cooling of the freezer compartment. To increase the cooling efficiency in the freezer compartment, the circulation of the cooling air in the freezer compartment can be increased by improving the flow characteristics of the cooling air emitted by the ice maker. In particular, an ice maker that improves the circulation of cooling air to a central interior portion of a freezer compartment, i.e., away from corner(s) of the freezer compartment, is desired.

Figure 3:
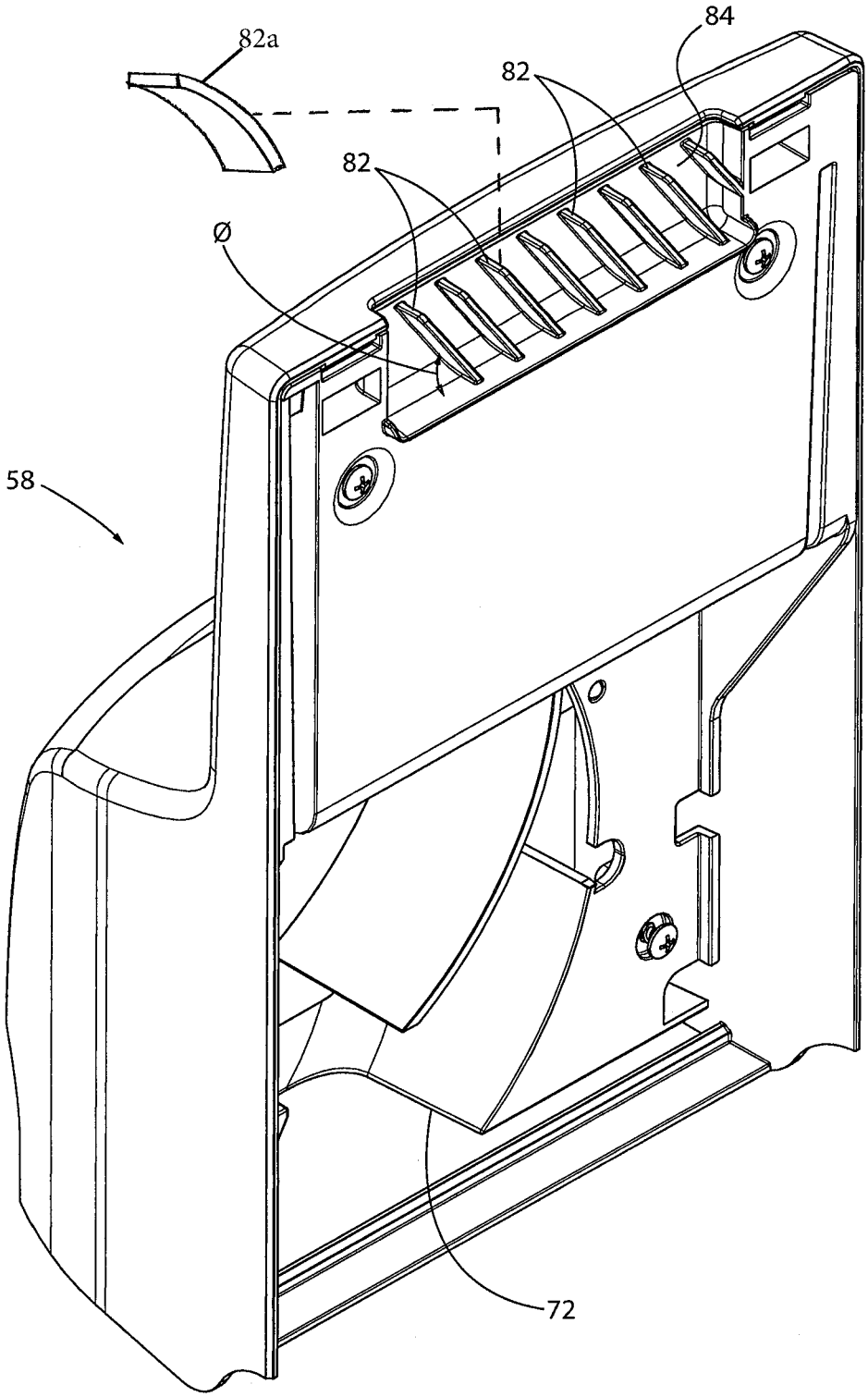
FIG. 3 is a perspective view of a front cover of the ice maker shown in FIG. 2.

In the embodiment shown in FIG. 3, a plurality of ribs 82 are disposed in a recess 84 formed in an upper end of the back surface of the front cover 58. The ribs 82 are flat planar elements that are disposed at an angle relative to a horizontal plane. In particular, the ribs 82 are disposed at an angle θ that is less than 90 degrees. It is also contemplated that the ribs 82 may be curved (ribs 82*a* in FIG. 3) or of various lengths and orientations so as to obtain the desired flow characteristics for the cooling air exiting the ice maker 50. For example, some of the ribs 82 may be oriented in a first direction whereas other ribs 82 may be oriented in a second, different direction. However, if a more laminar (i.e., less turbulent) air flow is desired out of the ice maker 50, some (including a majority) or all of the ribs 82 may be aligned, such as at substantially the same angle, thereby increasing the airflow efficiency in the freezer compartment 14.

In the embodiment shown, the ribs 82 have a fixed orientation. It is contemplated that the ribs 82 may be adjustable by an operator to achieve a desired flow characteristic. For example, one or more of the ribs 82 can be pivotal such that the angle of the one or more ribs 82 relative to a horizontal plane can be individually or collectively varied. Once the desired orientation of the one or more ribs 82 is obtained, the ribs 82 can be locked into that orientation to prevent a user from changing the orientation of the ribs 82 at a later time.

In the embodiment shown, the ribs 82 are attached to the front cover 58. It is contemplated that all or some of the ribs 82 may be formed in the front horizontal edge 57*a* of the frame 54 at a location opposite the recess 84 in the front cover 58. For example, FIG. 2 shows a plurality of ribs 82B disposed in a recess 84B formed in the frame 54. It is also contemplated that one or more of the ribs 82 may be split between the front cover 58 and the frame 54. For example, a first portion of at least one rib 82 may be formed in the front cover 58 and a remaining second portion of the at least one rib 82 may be formed in the front horizontal edge 57*a* of the frame 54. Some or all of the ribs can be integrally molded in. It is also contemplated that the ribs 82*a* (FIG. 3) can be a component that is separate from the front cover 58 and the frame 54 and is dimensioned to be received into the recess 84 in the front cover 58. The ribs 82*a* can be secured into the opening using any one of a variety of methods, including by not limited to, fasteners, snap-fit, interference fits, adhesives, etc. The method of securing the ribs 82*a* can be selected such that an operator can quickly and easily install and test ribs with different configurations until a rib configuration that provides a desired flow characteristic in the freezer compartment 14 is found. The foregoing embodiment finds particular advantageous application where the ice maker 50 and/or the front cover 58 is used in multiple refrigerators 10 having freezer compartments 14 of different sizes and configurations.

As described in several of the embodiments above, the ribs 82 can be formed in the frame 54. It is also contemplated that the housing 53 of the ice bin 52 could include an upper front, horizontal edge portion (not shown) that is dimensioned to mate with the upper end of the back surface of the front cover 58. In this embodiment, instead of the ribs 82 being formed in the frame 54 of the ice maker 50, the ribs 82 alternatively can be formed in the housing 53 of the ice bin 52. In this embodiment, replacement of the ribs 82 can be accomplished by replacing one ice bin 52 with another ice bin 52 having a desired rib configuration. Alternatively, the ribs 82 can be formed in the front cover 58 or be a separate component and the upper front, horizontal edge portion of the housing 53 can be positioned opposite the recess 84 formed in the front cover 58. As such, the upper front, horizontal edge portion of the housing 53 would be used in a similar manner as described above for the front horizontal edge 57*a* of the frame 54.

Referring back to FIG. 4, when the ice bin 52 is positioned within the frame 54 of the ice maker 50, the recess 84 in the front cover 58 is positioned adjacent the front horizontal edge 57*a* of the frame 54 such that the front cover 58 and the front horizontal edge 57*a* of the frame 54 define a gap 86 therebetween. The gap 86 defines an upper air outlet pathway "E" that fluidly communicates with the internal cavity 52*a* of the ice bin 52. The plurality of ribs 82 are positioned within the upper air outlet pathway "E" for redirecting the air conveyed therealong into a predetermined direction away from the ice maker 50 and into the freezer compartment 14, as described in detail below. As discussed in detail above, it is also contemplated that the plurality of ribs 82 may be formed in one or both of the front cover 58 and the frame 54, or the ribs 82 can be a separate component that is received into the gap 86.

As noted above, it is also contemplated that the housing 53 of the ice bin 52 may include an upper front, horizontal edge portion (not shown) that mates with the upper end of the back surface of the front cover 58. In this embodiment, the gap 86 is formed between the upper front, horizontal edge portion of the housing 53 and the back surface of the front cover 58. As described in detail above, the ribs 82 can be formed in one or both of the front cover 58 and the housing 53, or the ribs 82 can be a separate component that is received into the gap 86.

During operation of the ice maker 50, a fan (not shown) conveys air over an evaporator in the freezer compartment 14. The air flowing over the evaporator is cooled to a predetermined below freezing temperature. As shown in FIG. 7, the cooled air flows into the ice maker 50 along the air inlet pathway "A." A portion of the air flows along the first branch 64*a* and a portion of the air flows along the second branch 64*b*. The air flowing along the first branch 64*a* flows along upper air pathway "B" and is directed over the ice tray 62 in the ice maker 50. The low temperature of the air causes the water in the ice tray to freeze and form ice pieces. The air then exits through the channel 66 and is injected into the internal cavity 52*a* of the ice bin 52. A portion of the cool air in the space above the ice tray 62 also exits through the side opening 55 formed in the frame 54 (best seen in FIG. 2). The side opening 55 forms a side air outlet pathway "F" that is directed toward a central portion of the freezer compartment 14 to maintain the articles in the freezer compartment 14 in the frozen state.

Figure 4:
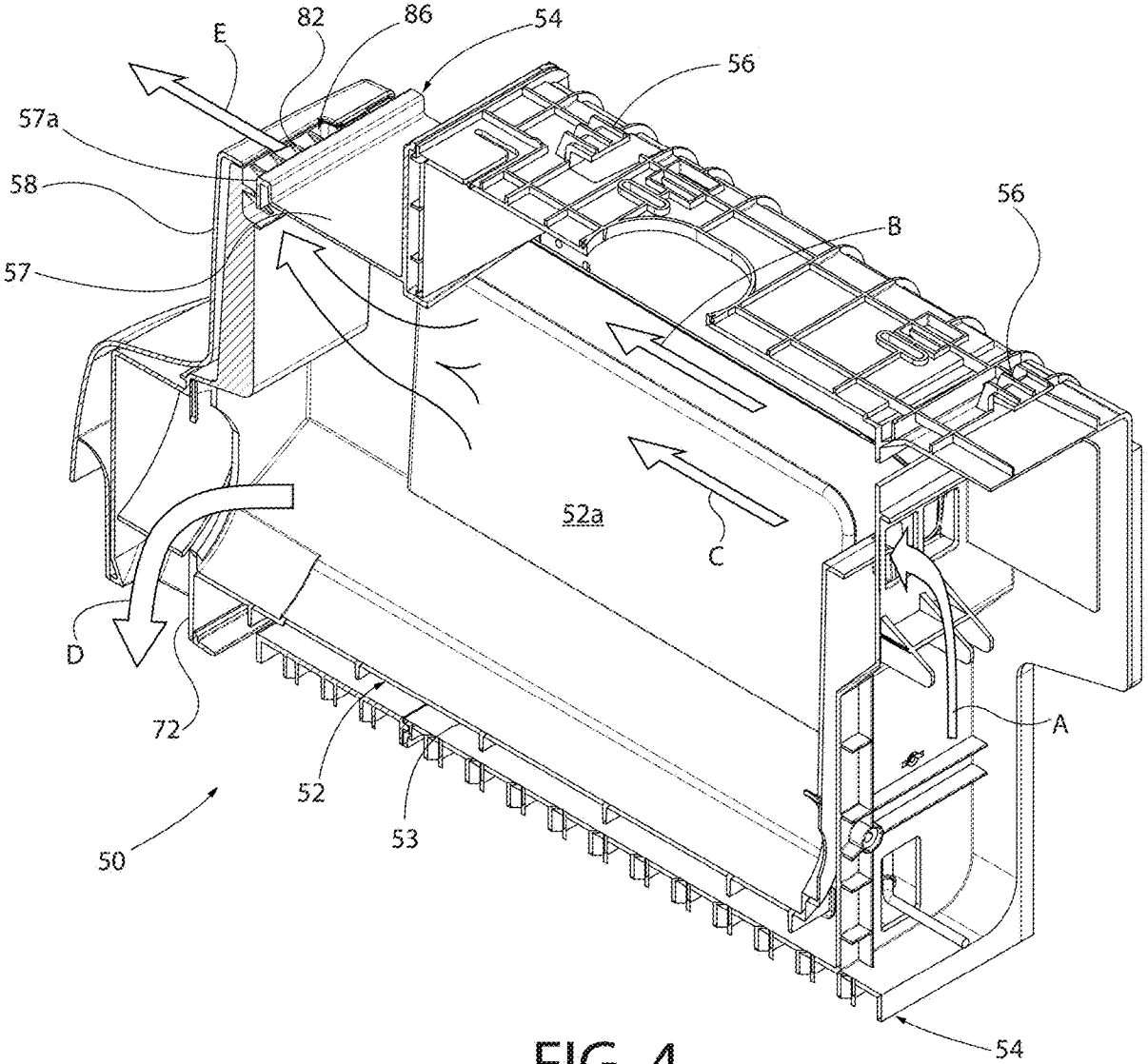
FIG. 4 is a section view showing an interior of the ice maker of FIG. 2.
Figure 5:
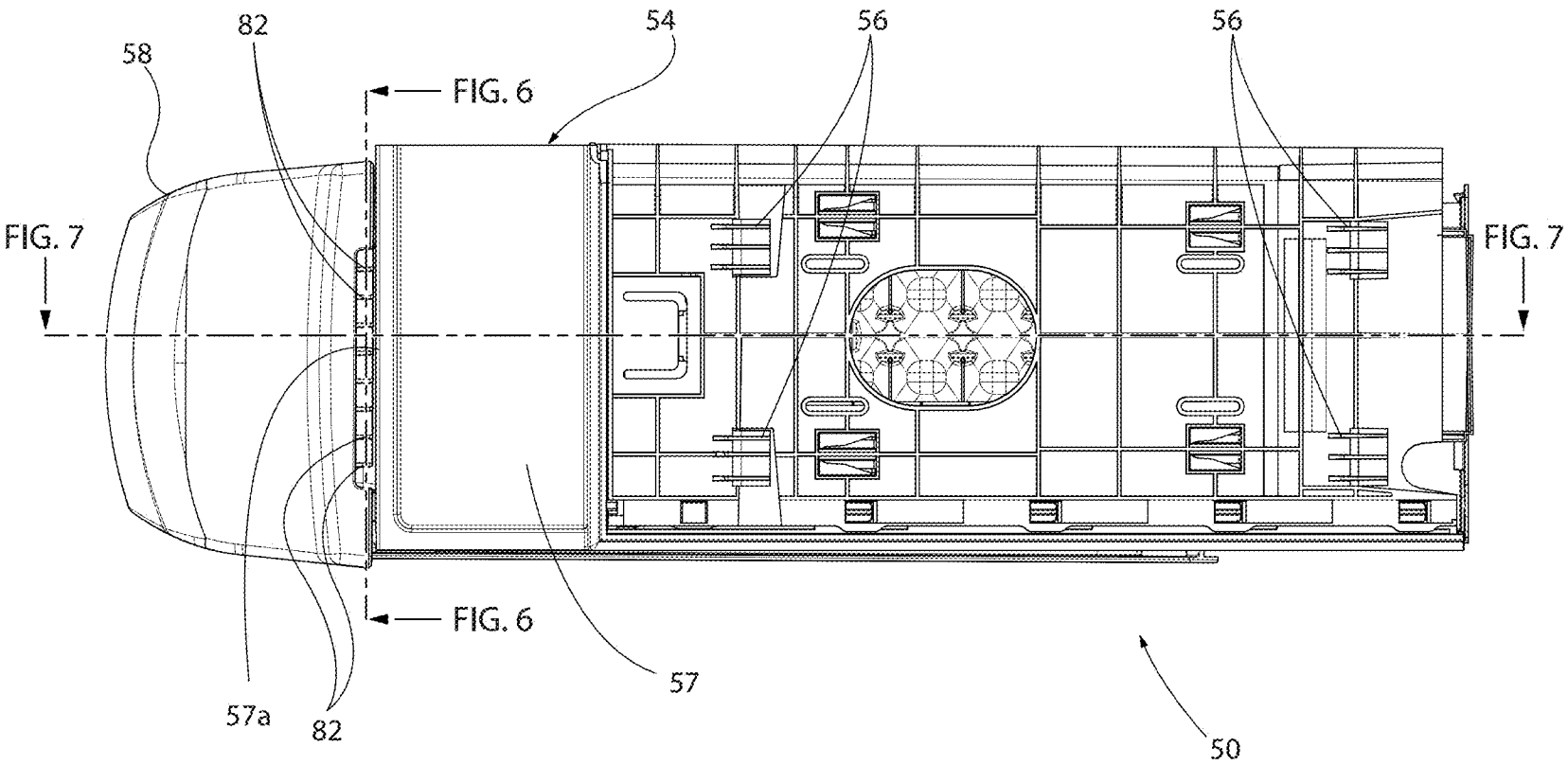
FIG. 5 is a top plane view of the ice maker shown of FIG. 2.
Figure 6:
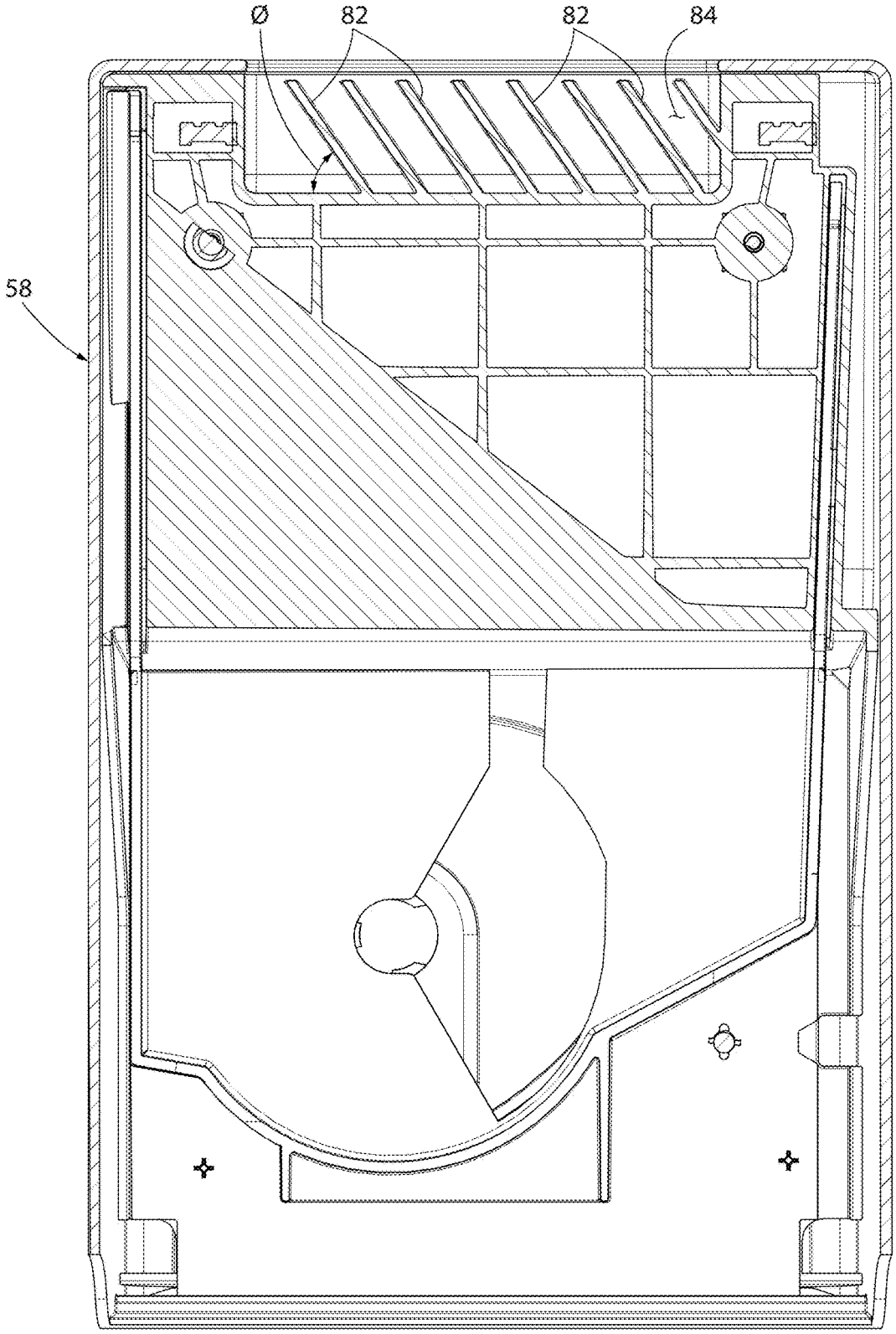
FIG. 6 is a section view taken along line 6-6 of FIG. 5.

Referring now to FIGS. 4 and 7, the portion of the air directed along the lower branch 64*a* is conveyed into the internal cavity 52*a* of the ice bin 52 of the ice maker 50 along lower air pathway "C" to maintain the ice pieces in the ice bin 52 in the frozen state. The air conveyed along the upper air pathway "B" combines with this lower air within the internal cavity 52*a*. The combined air in the internal cavity 52*a* is then forced towards a front of the ice bin 52 and out of the ice maker 50 via the gap 86 along the upper air outlet pathway "E." In particular, as shown in FIG. 2, the air flowing along the upper air outlet pathway "E" is redirected by the plurality of ribs 82 into a direction toward a center of the freezer compartment 14 to cool the food therein. Preferably, the upper air outlet pathway "E" directs the cooled air in a direction similar to the cooled air exhausted along the side air outlet pathway "F."

The air in the freezer compartment 14 flows in a downward direction through the freezer compartment 14, is then drawn back by the evaporator fan and is recirculated along the foregoing flow pathways. As such, the air exiting the ice maker 50 creates an efficient circulation pattern within the freezer compartment 14 and eliminates cold air clustering in upper corners of the freezer compartment 14 for maintaining the overall contents of the freezer compartment 14 in the frozen state.

In addition or alternatively, the ice maker of the instant application may further be adapted to mounting and use on a freezer door. In this configuration, although still disposed within the freezer compartment, at least the ice maker (and possibly an ice bin) is mounted to the interior surface of the freezer door. It is contemplated that the ice mold and ice bin can be separated elements, in which one remains within the freezer cabinet and the other is on the freezer door.

Cold air can be ducted to the freezer door from an evaporator in the fresh food or freezer compartment, including the system evaporator. The cold air can be ducted in various configurations, such as ducts that extend on or in the freezer door, or possibly ducts that are positioned on or in the sidewalls of the freezer liner or the ceiling of the freezer liner. In one example, a cold air duct can extend across the ceiling of the freezer compartment, and can have an end adjacent to the ice maker (when the freezer door is in the closed condition) that discharges cold air over and across the ice mold. If an ice bin is also located on the interior of the freezer door, the cold air can flow downwards across the ice bin to maintain the ice pieces at a frozen state. The cold air can then be returned to the freezer compartment via the plurality of ribs discussed herein, or alternatively can be ducted back to the evaporator of the freezer compartment. A similar ducting configuration can also be used where the cold air is transferred via ducts on or in the freezer door. The ice mold can be rotated to an inverted state for ice harvesting (via gravity or a twist-tray) or may include a sweeper-finger type, and a heater can be similarly can be used. It is further contemplated that although cold air ducting from the freezer evaporator as described herein may not be used, a thermoelectric chiller or other alternative chilling device or heat exchanger using various gaseous and/or liquid fluids could be used in its place. In yet another alternative, a heat pipe or other thermal transfer body can be used that is chilled, directly or indirectly, by the ducted cold air to facilitate and/or accelerate ice formation in the ice mold. Of course, it is contemplated that the ice maker of the instant application could similarly be adapted for mounting and use on a freezer drawer.

Alternatively, it is further contemplated that the ice maker of the instant application could be used in a fresh food compartment, including the plurality of ribs used to direct air exiting an internal cavity of the removable ice bin back into the fresh food compartment, either within the interior of the cabinet or on a fresh food door. It is contemplated that the ice mold and ice bin can be separated elements, in which one remains within the fresh food cabinet and the other is on the fresh food door.

In addition or alternatively, cold air can be ducted from another evaporator in the fresh food or freezer compartment, such as the system evaporator. The cold air can be ducted in various configurations, such as ducts that extend on or in the fresh food door, or possibly ducts that are positioned on or in the sidewalls of the fresh food liner or the ceiling of the fresh food liner. In one example, a cold air duct can extend across the ceiling of the fresh food compartment, and can have an end adjacent to the ice maker (when the fresh food door is in the closed condition) that discharges cold air over and across the ice mold. If an ice bin is also located on the interior of the fresh food door, the cold air can flow downwards across the ice bin to maintain the ice pieces at a frozen state. The cold air can then be returned to the fresh food compartment via the plurality of ribs discussed herein, or alternatively can be ducted back to the compartment with the associated evaporator, such as a dedicated icemaker evaporator compartment or the freezer compartment. A similar ducting configuration can also be used where the cold air is transferred via ducts on or in the fresh food door. The ice mold can be rotated to an inverted state for ice harvesting (via gravity or a twist-tray) or may include a sweeper-finger type, and a heater can be similarly can be used. It is further contemplated that although cold air ducting from the freezer evaporator (or similarly a fresh food evaporator) as described herein may not be used, a thermoelectric chiller or other alternative chilling device or heat exchanger using various gaseous and/or liquid fluids could be used in its place. In yet another alternative, a heat pipe or other thermal transfer body can be used that is chilled, directly or indirectly, by the ducted cold air to facilitate and/or accelerate ice formation in the ice mold. Of course, it is contemplated that the ice maker of the instant application could similarly be adapted for mounting and use on a fresh food drawer.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A refrigeration appliance comprising:

a freezer compartment for storing food items in a sub-freezing environment having a target temperature below zero degrees Centigrade; and an ice maker disposed within the freezer compartment for freezing water into ice pieces, the ice maker comprising:

a removable ice bin having an internal cavity for storing the ice pieces produced within the ice maker, and a front cover for closing a front open end of the removable ice bin, the front cover including a front face oriented toward a front of the freezer compartment, a rear face, and a recess formed in the rear face, the recess having a vertical surface offset from the front face of the cover, the rear face of the front cover being disposed adjacent to a horizontal edge portion of the ice maker when the removable ice bin is disposed within the ice maker, wherein the vertical surface of the recess in the front cover is spaced from an opposing vertical surface of the horizontal edge portion to define a gap between the front cover and the horizontal edge portion, wherein the gap fluidly communicates with the internal cavity of the removable ice bin, and a plurality of ribs disposed within the gap for directing air exiting the internal cavity of the removable ice bin into a predetermined direction toward a central portion of the freezer compartment.

2. The refrigeration appliance of claim 1, wherein at least one of the plurality of ribs is a generally flat planar element.

3. The refrigeration appliance of claim 1, wherein at least one of the plurality of ribs is a generally curved element.

4. The refrigeration appliance of claim 1, wherein the plurality of ribs is disposed parallel to each other in a first direction.

5. The refrigeration appliance of claim 1, wherein at least one of the plurality of ribs is formed in the front cover of the ice maker.

6. The refrigeration appliance of claim 1, wherein at least one of the plurality of ribs is formed in the horizontal edge portion of the ice maker.

7. The refrigeration appliance of claim 1, wherein a first portion of at least one of the plurality of ribs is formed in the front cover of the ice maker and a remaining portion of the at least one of the plurality of ribs is formed in the horizontal edge portion of the ice maker.

8. The refrigeration appliance of claim 1, wherein at least one of the plurality of ribs is a component separate from the front cover and the horizontal edge portion of the ice maker, wherein the at least one of the plurality of ribs is dimensioned to be received into the gap defined between the front cover and the horizontal edge portion, and wherein the at least one of the plurality of ribs directs air exiting the internal cavity of the removable ice bin into the predetermined direction.

9. The refrigeration appliance of claim 1, wherein at least one of the plurality of ribs is fixed in the predetermined orientation.

10. The refrigeration appliance of claim 1, wherein at least one of the plurality of ribs is pivotally adjustable.

11. The refrigeration appliance of claim 1, wherein the recess in the rear face of the front cover is formed in an uppermost portion of the front cover and the recess includes a horizontal surface upon which the plurality of ribs are positioned.

12. The refrigeration appliance of claim 1, wherein the horizontal edge portion is a portion of a frame of the ice maker.

13. The refrigeration appliance of claim 1, wherein the horizontal edge portion is a portion of a housing of the removable ice bin.

14. A refrigeration appliance comprising:

a freezer compartment for storing food items in a sub-freezing environment having a target temperature below zero degrees Centigrade; and an ice maker disposed within the freezer compartment for freezing water into ice pieces, the ice maker comprising:

a frame having a horizontal edge portion;

a removable ice bin having an internal cavity for storing the ice pieces produced within the ice maker, and a front cover for closing a front open end of the removable ice bin, the front cover including a front face oriented toward a front of the freezer compartment, and a rear face disposed adjacent to the horizontal edge portion of the frame when the removable ice bin is disposed within the frame, and a recess formed in one of the rear face and the horizontal edge portion, wherein a vertical surface of the recess is spaced from an opposing vertical surface of the horizontal edge portion and offset from the front face of the front cover when the recess is formed in the front cover, and a vertical surface of the recess is spaced from the rear face of the front cover and offset from the vertical surface of the horizontal edge portion when the recess is formed in the horizontal edge portion, the recess defining a gap between the frame and the removable ice bin, wherein the gap fluidly communicates with the internal cavity of the removable ice bin; and a plurality of ribs disposed within the gap for directing air exiting the internal cavity of the removable ice bin into a predetermined direction toward a central portion of the freezer compartment.

15. The refrigeration appliance of claim 14, wherein the plurality of ribs is formed in the front cover of the ice maker.

16. The refrigeration appliance of claim 14, wherein the plurality of ribs is formed in the horizontal edge portion of the frame.

17. The refrigeration appliance of claim 14, wherein the plurality of ribs is a component separate from the front cover and the frame, wherein the plurality of ribs is dimensioned to be received into the gap defined between the front cover and the frame, and wherein the plurality of ribs directs air exiting the internal cavity of the removable ice bin into the predetermined direction.

18. The refrigeration appliance of claim 14, wherein at least one of the plurality of ribs is fixed in the predetermined orientation.

19. The refrigeration appliance of claim 14, wherein the recess in the rear face of the front cover is formed in an uppermost portion of the front cover and the recess includes a horizontal surface upon which the plurality of ribs are positioned.

20. The refrigeration appliance of claim 14, wherein a majority of the ribs are aligned at substantially the same angle.

* * * * *